United States Patent [19]

Corwin

[11] Patent Number: 4,773,310

[45] Date of Patent: Sep. 27, 1988

[54] FAN VENTILATOR HAVING MULTIPLE MODES OF OPERATION

[76] Inventor: Howard Corwin, 180 Scott Dr., Atlantic Beach, N.Y. 11509

[21] Appl. No.: 936,895

[22] Filed: Dec. 1, 1986

[51] Int. Cl.[4] ..... F24F 7/013

[52] U.S. Cl. ..... 98/34.5; 98/94.1

[58] Field of Search ..... 98/33.1, 34.5, 94.1

[56] References Cited

U.S. PATENT DOCUMENTS

| | | | |
|---|---|---|---|
| 2,152,614 | 3/1939 | Younger | 98/33.1 |
| 2,407,858 | 9/1946 | Whitefield | 98/94.1 |
| 2,583,555 | 1/1952 | Fields et al. | 98/94.1 |
| 2,594,688 | 4/1952 | Shapiro | 98/39.1 |
| 2,759,412 | 8/1956 | Knapp | 98/94.1 |
| 2,776,089 | 1/1957 | Burrowes et al. | 98/94.1 X |
| 2,787,207 | 4/1957 | Moore | 98/94.1 |
| 3,363,531 | 1/1968 | Kohlmeyer et al. | 98/34.6 |
| 3,385,516 | 5/1968 | Omohundro . | |
| 3,548,924 | 12/1970 | Gardner | 165/55 |
| 3,570,386 | 3/1971 | Baumann | 98/33.1 |
| 3,850,598 | 11/1974 | Boehm | 55/387 |
| 3,973,479 | 8/1976 | Whitely | 98/34.5 |
| 4,248,162 | 2/1981 | Skeist | 108/50 |
| 4,336,748 | 6/1982 | Martin et al. | 98/34.5 |
| 4,391,321 | 7/1983 | Thumberg | 165/34 |
| 4,509,411 | 4/1985 | Martin | 98/34.5 |

*Primary Examiner*—Harold Joyce

*Attorney, Agent, or Firm*—Paul C. Scifo

[57] ABSTRACT

A ventilator having a housing containing a plurality of electric fan units, each of which is mounted in an air channel provided in the housing for directing air through the ventilator. Within the housing, the air channels are formed by cowlings which surround the individual fan unit. The ventilator also includes a filter element mounted on the housing to filter air moved through the ventilator channels by the fan units. The ventilator further includes a controller featuring a plurality of switches and an electrical network for electrically connecting the fan units to a source of electrical power such as a wall socket. The switches of the controller are manually operable to permit selective activation of the fan units so that multiple modes of ventilator operation may be selected. In accordance with the multiple modes of operation, air may be filtered and moved through the ventilator either in a first direction or a second direction or in both a first direction and a second direction and circulated.

20 Claims, 4 Drawing Sheets

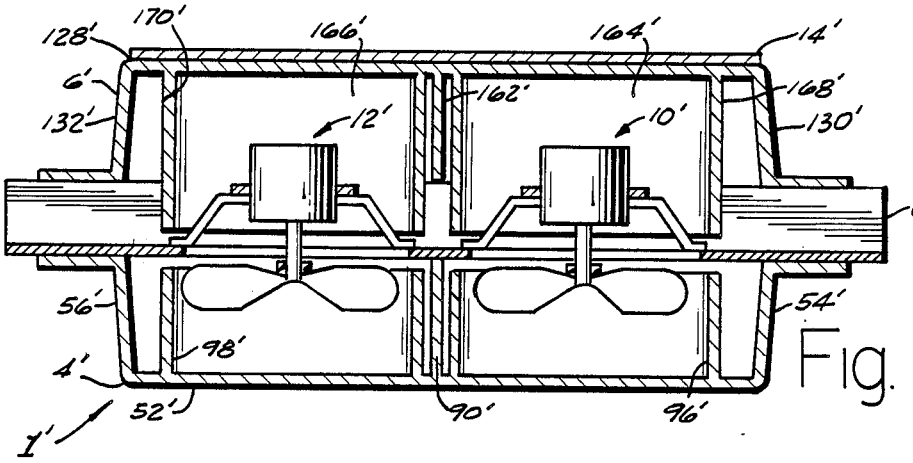
Fig. 7
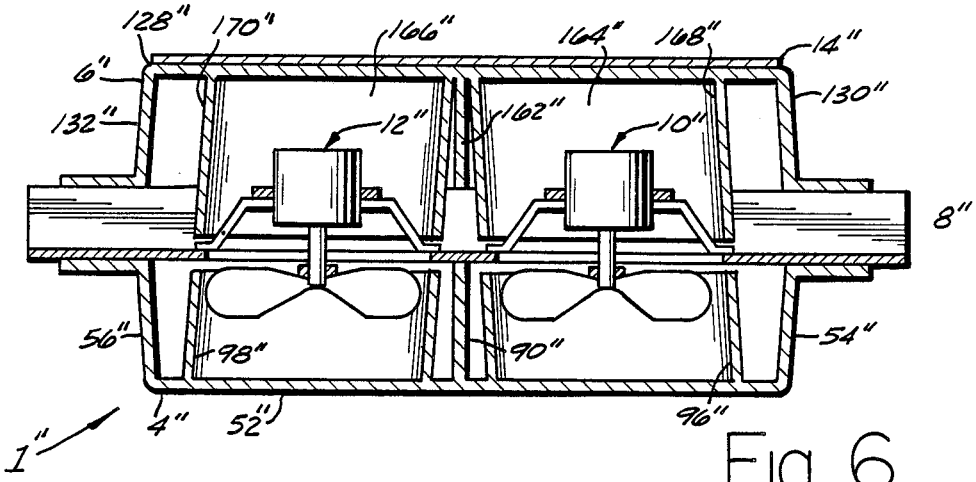
Fig. 6
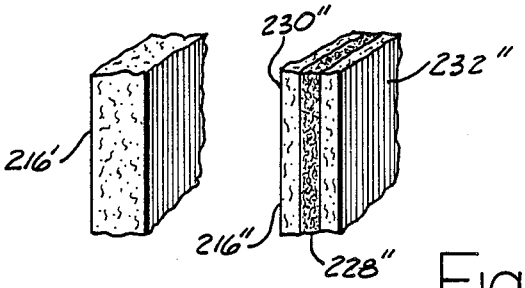
Fig. 8A
Fig. 8B

FAN VENTILATOR HAVING MULTIPLE MODES OF OPERATION

FIELD OF THE INVENTION

This invention concerns a ventilator having a plurality of fan units for moving air, and, more particularly, a ventilator having multiple modes of operation wherein the ventilator fan units may be electrically controlled to selectively move air through ventilator channels and filters so that air may be either moved in a first direction or a second direction or in a combination of directions and circulated.

BACKGROUND OF THE INVENTION

Electrical fans, although introduced more than 100 years ago, are still a viable alternative to contemporary air conditioners. In today's more demanding market, however, fan makers find that to maintain their competitiveness, they must offer systems which both have a wider range of features, and which retain traditional system low cost and simplicity.

While air conditioners have become a standard feature of contemporary life, they, nonetheless, have many drawbacks. They are costly to purchase and install, are expensive to operate and have complicated constructions which can be difficult to repair. Additionally, many people find the low temperature settings of air conditioners, typical of most usage, uncomfortable, particularly when moving between places which are air conditioned and those which are not. Yet further, many find the absence of fresh air associated with air conditioned environments both unnatural and unpleasant.

As a result, electric fans, first introduced in the early 1880's, have retained their popularity. Common electric room fans are typically on the order of one tenth the cost of room air conditioners, require no installation other than placement in a convenient location; e.g., floor, table, window, require minimal cost to operate and are exceedingly reliable because of their simplicity. Additionally, they are capable of producing comforting currents of natural air which avoid stark contrasts in temperature.

However, to broaden the appeal of their products, fan makers find they are required to offer a wider range of features; e.g., modes of operation, while maintaining low cost and simplicity. Since consumers seek value when considering whether or not to substitute a fan system either partially or wholly for air conditioners, they look for products that can do the most for them at the lowest price. Therefore, in addition to performing the conventional function of moving air, fan makers have proposed systems which also operate as ventilators; i.e., replace stale air with fresh air; as for example, by supplying fresh external air and exhausting stale air, important where room air may be particularly foul because of tobacco smoke or cooking odors, etc., or by circulating room, ambient air through a filtering means to refresh it, as where conservation of ambient temperature is important.

The problem has been that such enhancement of function; i.e., addition of modes of operation, have not been without the addition of undesirable complexity and cost. Further, due to the inconsistent nature of elements required for the various modes of operation, systems thus far proposed have been unable to combine a variety of such functions in a single, low cost, multipurpose unit. Particularly, systems which ventilate by taking in fresh air and exhausting stale air have not included means for filtering and circulating ambient air. Nor have systems designed to filter and circulate ambient air, typically portable units, included the more elaborate features found in fix mounted systems for ventilating by taking in fresh air and exhausting stale air. Further, the absence of added features in portable systems is particularly noticeable. The problem here is that because portable units stress low cost it is particularly difficult to add features to them without complicating their design and rendering them more expensive and less competitive.

For example, while portable fan ventilators have been proposed that can alternately supply external fresh air or exhaust stale air; i.e., reversible, portable fans, their designs are unable to filter and circulate ambient air or to simultaneously supply fresh air and exhaust stale air. U.S. Pat. No. 3,385,516 to W. A. Omohundro in an illustration. While primarily directed to an arrangement of fan hub and motor, the patent describes a portable fan unit having a single fan designed to either move air in one direction or the other; i.e., used either within the room to move air, or at a window to either supply fresh air or exhaust stale air. The unit, however, lacks any filter means and, therefore, is not capable of ventilation by circulating ambient air. As a result, the design sacrifices either temperature conservation for air purity, or vice versa, being able to address one concern or the other, but not both. Further, because the unit uses a single fan, it can not simultaneously supply fresh air and exhaust stale air. This potentially compromises air quality by limiting the rate stale is exchanged for fresh air, particularly a problem where room ventilation is limited to use of the fan alone.

While other fan ventilators have been proposed that are capable of simultaneously supplying external fresh air and exhausting stale air, they, however, are of intricate design, lack the ability to circulate and filter ambient air and are not portable to permit location as desired. An illustration of this type design is given in U.S. Pat. No. 2,152,614 to A. R. Younger. The Younger ventilator, while able to simultaneously take in fresh air and exhaust stale air, requires an elaborate combination of a single motor and dual, opposed fan blades, together with interwoven supply and exhaust channels. Additionally, the design expressly avoids communication between the supply and exhaust channels and fails to consider use of any filtering means. As a result, it is unable to ventilate by filtering circulated ambient air and, thereby, declines conservation of air temperature, Further, the design contemplates fixed installation in a wall or window, and is not transportable.

A yet further ventilator type is described in U.S. Pat. No. 2,850,598 to H. G. Boehm. In his specification, Boehm proposes a fan system that ventilates by circulating ambient air through a filter element, The system features a fan blade and drive motor axially disposed relative to a cylindrical filter element for drawing room air through the filter to refresh it and, thereafter, return it to the room. The system, however, is unable to supply fresh air from outside the room or to exhaust stale air to a region outside the room, thus potentially comprising air purity in heavily air fouled situations.

Continuing, fan ventilators have also been proposed which more closely approach the objective. But they too, for reasons of complexity and omitted features, fall short. U.S. Pat. No. 4,509,411 to E. T. Martin proposes a fan ventilator capable of adjustable supplying fresh air, exhausting stale air and mixing them with circulated ambient air. The system features two fixed direction fans coupled pneumatically by a manifold that can be adjustable split to let out varying amounts of exhausted stale air and let in varying amounts of fresh air to mix with circulating ambient air. While the system has the advantage of conserving the temperature (hot or cold) by circulating at least a portion of the ambient air, the system, nonetheless, fails to consider use of filtering means to refresh the circulated air, is of complicated design by virtue of the adjustable manifold and by its nature is intended to be fixed mounted, not portable.

Still further, while there are fan ventilators that contemplate the supply of filtred fresh air, exhaust of stale air and some circulation of ambient air, again, these systems fail to attain the objectives sought here. Particularly, U.S. Pat. No. 3,363,531 to H. Kohlmeyer et al. describes a fan ventilator for fixed mounting in walls such as those of a barn. The system, features a fan for drawing external fresh air through a port and channel located in the barn wall, and exhausting barn air externally through another port and channel in the barn wall. In accordance with the described system, a flap valve is provided between the supply and exhaust channels to enable controlled circulation of exhaust air with incoming fresh air. Still further, the design contemplates use of filtering means at the supply port, but, however, fails to consider or propose filtering of the circulated air at the flap valve. Additionally the design is large and cumbersome, being intended for fixed mounting and not transport.

Thus while fan systems have been with us for a long while, and offered in a variety of forms, no one design has been able to combine the various features in a single, low cost multi-purpose unit.

SUMMARY OF THE INVENTION

It is, therefore, an object of this invention to provide a fan ventilator of simple design, having multiple modes of operation.

It is a further object of this invention to provide a fan ventilator having multiple modes of operation which is portable.

It is a still further object of this invention to provide a fan ventilator having multiple modes of operation wherein the ventilator may be used to move filtered ambient air in either a first direction or a second direction or simultaneously in a first direction and a second direction and at least partially circulate the filtered ambient air; or either supply external fresh filtered air or exhaust stale air or simultaneously supply fresh filtered air and exhaust stale filtered air and at least partially circulate filtered ambient air.

It is a still further object of this invention to provide a fan ventilator having the multiple modes of operation described wherein the ventilator included a plurality of fan elements which may be manually controlled to select and vary the mode of operation as desired.

Briefly, the ventilator in accordance with this invention includes a housing containing a plurality of electric fan units arranged to cooperate with a plurality of air channels. The fan units and air channels are further arranged to cooperate with air filter elements disposed in association with the housing. Additionally, the ventilator includes electrical means for controlling the operation of the fan units so that air may be selectively moved through the ventilator air channels and filter elements to provide multiple modes of ventilator operation.

In a first mode of operation, the control means selectively activates fan units to move and filter air only in a first direction, the direction of air movement being determined by the orientation of the respective channels and the character of the fan unit activation. In a second mode of operation, the control means selectively activates the fan units to move and filter air only in a second direction. Again, air direction is determined by channel orientation and the character of fan unit activation.

In a third mode of operation, the control means selectively activates the fan units to move and filter air in the first direction and second direction and to at least partially draw air moving in one direction back through the filter means in the other direction, to at least partially double filter and circulate the air of the space ventilated.

In preferred for, the ventilator is portable, so that it may be positioned either within the space to be ventilated or at a window or port associated with the space. In accordance with the design, portability has the effect of doubling the ventilator modes of operation. Particularly, when placed within a space; e.g., on a table or the floor of a room, ambient room air may be moved and filtered in a first direction, or moved and filtered in the second direction, or moved and filtered both in the first and second directions and double filtered and circulated. Additionally, if the ventilator is placed in an open room window, fresh air from outside the room may be filtered and drawn into the room, or stale room air filtered and exhausted form the room, or fresh air filtered and drawn in and stale air filtered and exhausted and, further, at least a portion of the exhausted air filtered again and drawn back into the room together with the fresh air. Thus, the ventilator is able to maximize the amount of fresh air; i.e., draw in only fresh air, or maximize conservation of ambient air temperature; i.e., circulate double filtered, ambient room air. Yet additionally, these modes can be further multiplied varying the number of fan units activated and the speed at which they are operated.

In preferred form, the ventilator is configured with two air channels, each of which is provided with a reversible electric fan for moving air along the length axis of the respective channels in either one direction or the other. Additionally, the ventilator includes filter elements of either woven or non-woven design and constant or varying density, or other specialized construction, for filtering the air that moves through the respective air channels.

Also in preferred form, the air channels are defined by cowlings that surround the fan units. The cowlings are formed as part of a housing having a front shell and a rear shell, the fans being mounted on a frame member at least partially enclosed by the housing shells.

Additionally, and in preferred form, the contol means includes a plurality of manually operated switches and an electrical network for connecting the fans with a source of electrical power. The switches are mounted within the housing and are provided with buttons that protrude through the housing so they can be manually set to select the various ventilator modes of operation.

The housing also includes retractable support assemblies to enable the ventilator to freely stand; e.g., on a table or floor, etc. As well, the ventilator includes retractable partitions slidably received in the housing frame member which permit the ventilator to be mounted in a window or wall port.

In one embodiment of preferred form, the length axes of the air channels are arranged at a convergent angle so that air moving in the channels may at least partially co-mingle at one like end of the channels to encourage the air circulation associated with the third mode of operation. In one case this is faciliated by providing the cowlings with an asymmetrical radial contours along the length of the air channels that orient the channel axes at a convergent angle. In another case, substantially cylindrical cowlings are mounted on the housing shells with their length axes fixed at a convergent angle.

In another embodiment of preferred form, the ventilator air channels are disposed in close proximity so that air may co-mingle at like channel ends to encourage the circulation associated with the third mode of operation. In a yet further embodiment, air deflector elements are provided on one like end of the channels to cause the air moving in the respective channels to co-mingle at the channel ends where the deflector is provided, thereby facilitating the circulation associated with the third mode of operation.

DESCRIPTION OF THE DRAWINGS

The above and other features and advantages of the ventilator in accordance with this invention will become clear from the following more detailed description read in conjunction with the accompanying drawings in which;

FIG. 6 is a sectional plan view of an alternate embodiment of the ventilator air channels in accordance with the invention;

FIG. 7 is a sectional plan view of an yet another embodiment of the ventilator air channels in accordance with the invention; and FIGS. 8A, 8B, are fragmented isometric views of various forms of the ventilator filter means in accordance with this invention.

DESCRIPTION OF PREFERRED EMBODIMENT

As noted above, makers of fan systems have sought to broaden the appeal of their products by offering a wider range of system capability, while, retaining traditional system simplicity and low cost. In addition to offering the ability to move air; i.e., create air currents, makers have offered systems capable of ventilating; i.e., refreshing room air by either exhausting stale air and supplying external, fresh air, or by circulating room air through a filtering means. These two approaches, while seemingly the same, are different. Each has its advantages and disadvantages. Ventilating by exhausting stale room air and taking in external, fresh air assures removal of contaminants; e.g., smoke, fumes, etc. But, this exchange causes loss of room temperature in cold weather and increase of temperature in warm weather. As a result, additional energy, with its attendant cost, must be expended to restore desired air temperature. On the other hand, while circulating filtered room air conserves temperature, it risks inadequate refreshing of heavily fouled air.

For reasons of design complexity and costs, past ventilator designs have not combined both these features in a single unit. Rather, past designs have opted for one or the other electing either to emphasize air freshness, or temperature conservation. This has compelled consumers to either buy several different types of systems or sacrifice one concern or the other.

The ventilator in accordance with this invention solves this design problem by combining in a single, low cost system multiple modes of operation that provide both improved air freshness and air temperature conservation. Particularly, the ventilator of this invention not only moves air in a conventional fashion, but also ventilates by either supplying fresh air and exhausting stale air, or circulating filtered, ambient room air. Thus, the single unit permits the user to either emphasize air quality by providing fresh, external air or to emphasize temperature conservation (hot or cold) by circulating and filtering ambient air.

Figure 1:
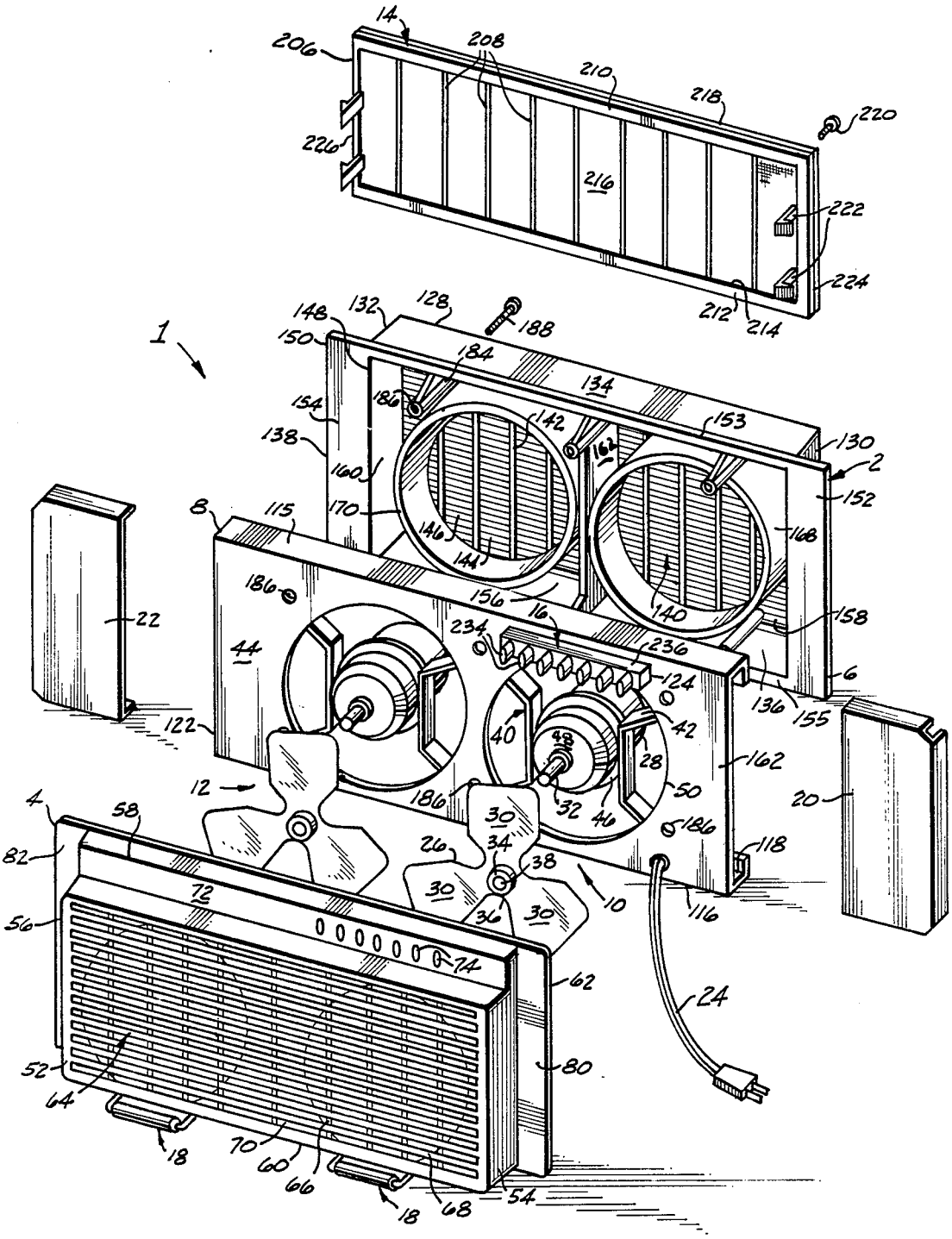
FIG. 1 is an exploded isometric view of the ventilator in accordance with the invention.

The ventilator of this invention is shown in a first form in FIG. 1. As seen there, ventilator 1 includes a housing assembly 2 having a front housing shell 4 and a rear housing shell 6 mounted upon a housing frame member 8. Additionally, ventilator 1 includes a pluraltiy of fan units 10 and 12 fixed to frame member 8 for moving air through the ventilator. Ventilator 1 is also seen to include a filter assembly 14 mounted on rear housing shell 6 to filter air moved through the ventilator. Still further, ventilator 1 includes a ventilator controller 16 mounted on frame 8 which permits manual selection of the different modes of ventilator operation.

Continuing with reference to FIG. 1, ventilator 1 is also seen to have retractable support assemblies 18 to enable the ventilator to stand freely, and frame extension panels 20, 22 to permit window mounting. A power cord 24 is provided for connecting the ventilator to a conventional wall socket, not shown, to supply electrical power to controller 16 and, subsequently, to fan units 10 and 12.

As shown in FIG. 1, ventilator 1 includes a plurality of fan assemblies which in the preferred form shown consists of two axial flow units 10, 12, respectively, mounted on the right and left of frame member 8. The fan units are alike, and can be understood by referring to unit 10 on the right.

Unit 10 is seen to include a fan blade 16 and a drive motor 28. Blade 26 has a pluraltiy of vanes 30 which, as shown, are three in number. As will be appreciated by those skilled in the art, the specific number of blade vanes is optional, and depends upon the air flow desired and the characteristics of drive motor 28. Fan blade 26 is mounted to a motor drive shaft 32 in a conventional fashion; e.g., by means of a bushing 34 disposed at fan blade hub 36. As shown, bushing 34 is provided with a bore 38 sized to permit bushing 34 and blade 26 to be forced onto and retained at motor shaft 32.

Fan drive motor 28 is mounted to frame 8 by support assembly 40. Assembly 40 includes a pair of mounting struts 42, one provided on either side of motor 28 and fastened; e.g., by spot welding, to main panel 44 of frame 8. Struts 42 are joined by a motor receiving hoop 46 centrally disposed and fastened there between for receiving drive motor housing 48. Struts 42 and hoop 46 position and mount motor 48 centrally in fan aperture 50 provided at frame main panel 44 as best seen in FIG. 1.

Fan drive motor 28 is of the alternating current, single phase, squirrel-cage, permanent-split, capacitor type operated from a motor power circuit to be more fully described hereafter. Additionally, motor 28 is provided with multiple windings to permit multi-speed operation.

Continuing with reference to FIG. 1, housing front shell 4 is seen to be a generally rectangular, three-dimensional element. Viewed from the front, shell 4 has a front wall 52, right and left side walls 54, 56, respectively, top wall 58, bottom wall 60 and back wall 62.

As shown, front wall 52 features a generally rectangular, flat grille work 64 of latticed vertical and horizontal rigs 66, 68, respectively. Generally rectangularly shaped apertures 70 through which air may pass are formed by ribs 66, 68 of the grille work. The size of apertures 70 is determined by the cross-sectional area of grille work 64, and the number and placement of ribs 66, 68, and further depends upon the air flow to be handled by the ventilator, as is known in the art.

Figure 3:
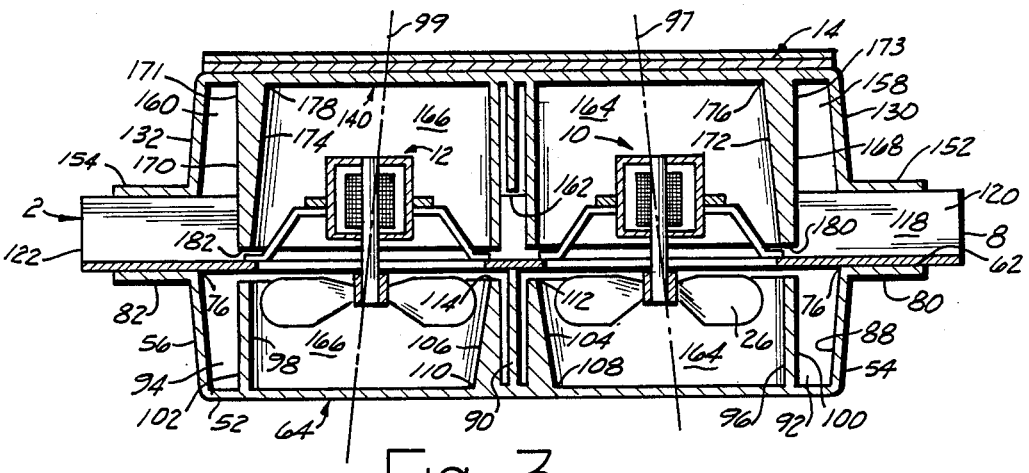
FIG. 3 is a sectional plan view of the ventilator in accordance with the invention, taken along lines 3—3 of FIG. 2.
Figure 4:
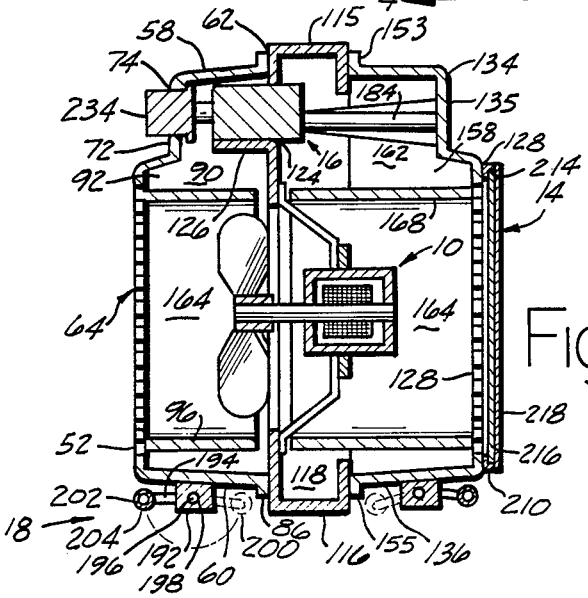
FIG. 4, is a side sectional elevation view of the ventilator in accordance with the invention, taken along lines 4—4 of FIG. 2.

Side walls 54 and 56 of front shell 4, like wall 52, are generally rectangular and flat, extending at obtuse angles from front wall 52 to back wall 62 as best seen in FIG. 3. Continuing with reference to FIG. 1, top wall 58 is also rectangular, but stepped to form a vertically disposed control panel 72 having a plurality of apertures 74 there through. While aperture 74 may be positioned for convenience, in the form shown, they are located proximate right wall 54, extending toward left wall 56. As best seen in FIG. 4, top wall 58 extends back from wall 52 towards back wall 62 at an obtuse angle, and, as noted, is stepped to form panel 72.

Continuing with reference to FIG. 4, bottom wall 60 is also generally rectangular and flat, extending from front wall 52 to back wall 62 at an obtuse angle. Ventilator support assemblies 18 are provided on bottom wall 60 to enable housing 2 to freely stand, as will be more fully described hereafter.

Figure 2:
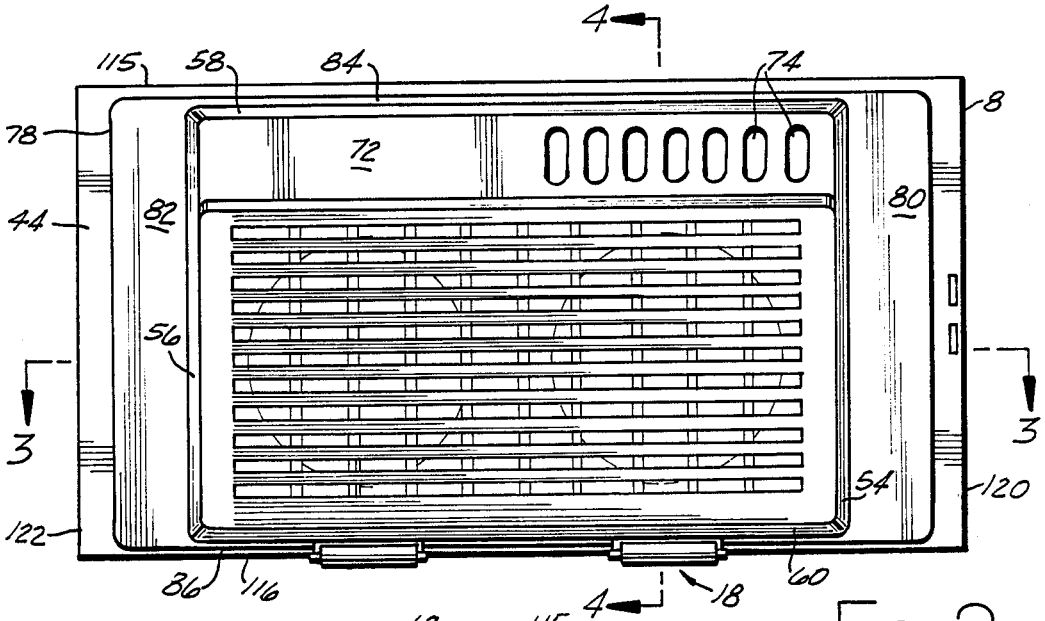
FIG. 2 is a front elevation view of the ventilator in accordance with the invention.

With reference to FIGS. 2 and 3, ventilator back wall 62 is seen to be generally rectangular, but formed primarily open, having a rectangular aperture 76 framed by a border 78 arranged flanged to the top, bottom and side walls of shell 4. As seen in FIG. 2, border 78 includes side apron segments 80 and 82 which extend respectively from side wall 54 and 56 to cover at least a portion of frame 8. Additionally, border 78 includes top and bottom apron segments 84, 86 extending, respectively, from top wall 58 and bottom wall 60. As seen, segments 84 and 86 are substantially smaller than segments 80, 82.

With reference to FIGS. 3 and 4, back wall aperture 76 is sized to encompass fan units 10, 12 and controller 16 to enable shell 4 to enclose the motor units and controller at frame 8 from the front. As formed, front shell 4 includes an internal cavity 88 having a cross section corresponding to aperture 76 and a depth substantially equal to the width of side walls 54, 56.

As seen in FIG. 3, cavity 88 is provided with a partition 90 extending orthogonally and substantially centrally between top wall 58 bottom wall 60 and front wall 52. Partition 60 divides cavity 88 into substantially equally sized compartments 92 and 94 which align with and receive fan units 10 and 12, respectively, particularly fan blade 26. Compartments 92, 94 generally form the front section of right and left side air channels, respectively, 164, 166. Channels 164, 166 conduct and direct air driven through the ventilator by fan units 10 and 12. In preferred form, compartments 92 and 94 include fan cowlings 96, 98 to specifically form the front sections of air channels 164, 166, respectively. Cowlings 96, 98 are positioned substantially centrally relative to fan blades 16 and extend from the rear face of grille work 64 into compartments 92, 94, respectively, and poximate frame 8 to surround blades 26.

Cowlings 96, 98 are provided to enhance the efficiency of air flow and improve air flow directionality. As is well known in the art, axial-flow fans, such as used in the ventilator of this invention, while desirable for their simplicity and low cost, suffer from inefficiency of air movement. Particularly, energy expended in driving the fan blade creates, in addition to a useful axial air flow which may be directed as desired, a waste, radial component of air, orthogonal to the desired direction.

In the ventilator of this invention, to improve efficiency, cowlings 96, 98 are provided to deflect and redirect the otherwise waste, radial component of air movement to the preferred axial flow direction. This increases the preferred flow and with it, fan efficiency. In addition, orientation of the length axis 97, 99, of cowlings 96, 98, and accordingly, channels 164, 166, respectively, enables the movement of air to be further controlled. Instead of air direction being determined solely by fan orientation, the orientation of the cowling length axis (air channel axis) may be adjusted to deflect the axial flow, and thereby, direct air movement as desired. As will be more fully described hereafter, this enables the ventilator air streams to be co-mingled at the rear of the ventilator to aid air circulation and multi-mode operation.

In a first form of the invention, the external contour 100, 102 of fan cowlings 96, 98, respectively, are substantially cylindrical and disposed orthogonally to grille work 64 and frame 8 as seen in FIG. 3. However, cowlings 96, 98 are provided with radially asymmetrical internal contours 104, 106 on the inboard portion of the cowling so that the effective internal length axes 97, 99 of the cowlings are disposed at a convergent angle; i.e., an angle that causes the cowling internal length axes to converge rearwardly of housing 2.

With reference to FIGS. 2 and 3, asymmetrical internal contours 104, 106 are formed by reducing the internal radius of the otherwise circular cowling cross section over half its area. Particularly, when viewing the cross section of right side cowling 96 from the front, as in FIG. 2, the cross section radius is diminished over the inboard portion of the cowling cross section, as it is swept counter clockwise from the vertical (90 degree point) to the horizontal (180 degree point) and again increased as the radius is further swept counter clockwise from the horizontal (180 degree point) to the vertical below the horizontal (270 degree point). With respect to left side cowling 98, the radius is reduced over the inboard half of the cowling cross-section as the radius is swept clockwise from the vertical to the horizontal, and increased as swept further clockwise to the vertical below the horizontal. Additionally, and as best seen in FIG. 3, the degree to which the radius is diminished is decreased from cowling ends 108, 110 at grille work 64 to cowling ends 112, 114, proximate frame 8. Forming the cowlings with radially asymmetrical internal contours and cylindrical external contours is particularly attractive from a cost perspective because it permits the cowlings and housing shells to be molded as one piece units, as will be appreciated by those skilled in the art.

Continuing with reference to FIGS. 1 and 3, ventilator housing 2 includes a frame member 8 upon which fan units 10, 12 and controller 16 are mounted. As shown, frame 8 includes a generally rectangular, flat main panel 44 which is folded in "U" form at frame top side 115 and bottom side 116. Folding of panel sides 115 and 116 in this fashion forms a channel 118 suitable for slideably receiving panel extensions 20, 22, respectively, at frame sides 120, 122. As is well-known in the art, extensions 20, 22 may be used to adjust the width of panel 44 so that the ventilator can be snugly fit into windows or other ports of various widths; as for example, where the ventilator is taking in fresh air or exhausting stale air. As best seen in FIG. 1, and as noted, panel 44 further includes apertures 50 for receiving fan units 10, 12 and, thus, further defines ventilator air channels 164, 166. Panel 44 also includes aperture 124 for receiving controller 16. As seen in FIG. 4, aperture 124 may be conveniently created by bending out a section of panel 44 to form a mounting ledge 126 upon which controller 16 can be fixed in any convenient fashion.

Continuing with reference to FIG. 1, ventilator housing 2 also includes a rear housing shell 6, As shown, shell 6 is substantially similar to front shell 4. In preferred form, shells 4 and 6 may be made by molding, and in the interest of simplicity and cost, made with similar molds. It is a generally rectangular, three-dimensional element having a rear wall 128, side walls 130, 132, respectively, a top wall 134, bottom wall 136 and a back wall 138. As in the case of front wall 52 of shell 4, rear wall 128 of shell 6 features a generally rectangular, flat grille work 140 of latticed vertical and horizontal ribs 142, 144 having rectangularly shaped apertures 146 there between through which air may pass. As noted, in connection with grille work 64, the size of apertures 146 are determined by the grille cross-sectional area, number and placement of ribs 142, 144 and the desired air flow characteristics for the ventilator.

Side walls 130, 132 of shell 6 are flat and rectangular and extend at obtuse angles from rear wall 128 to back wall 138 as best seen in FIG. 3. Like top wall 58 of shell 4, top wall 134 of shell 6 is also stepped to form a vertical panel 135, best seen in FIG. 4. However, panel 135 is without other distinguishing features and is provided stepped like wall 58 of shell 4 in preferred form to permit use of generally similar molds for shell 4 and 6, as noted. Continuing with reference to FIG. 4, bottom wall 136 is again similar to that of shell 4, being rectangular and flat, sloping back from rear wall 128 to back wall 138. Stand assemblies 18 are provided at wall 136 to permit housing 2 to stand freely.

With reference to FIG. 1, back wall 138 of shell 6 is generally rectangular, but, formed primarily open. Back wall 138 is formed with a rectangular aperture 148 framed by a border 150 flanged at the top, bottom and side walls of shell 6. Like border 78 of shell 4, border 150 of shell 6 has side apron segments; i.e., segments 150, 154 extending from side walls 130, 132, respectively, and top and bottom aprons; i.e., segments 153, 155 of smaller size extending from top wall 134 and bottom wall 136. As seen in FIGS. 1 and 3, the aprons of shell 6 cover at least a portion of frame main panel 44 and align with the aprons of shell 4 to be aesthetically pleasing.

Back wall aperture 148 is sized to encompass fan assembly 10, 12, particularly motors 28 and their mountings, as well as controller 16. Aperture 48 thereby permits rear shell 6 to enclose the motors and the controller at frame 8 from the rear. As formed, shell 6 includes an internal cavity 156 having a cross section equal to aperture 148 and a depth substantially equal to the width of side walls 132, 134. As seen in FIGS. 1 and 3, cavity 156 is divided into substantially equal compartments 158, 160 by a partition 162 corresponding to and aligning with partition 90 of shell 4. Compartments 158, 160, in accordance with the invention, generally form the rear sections of air channels 164, 166, respectively, which direct and conduct air through the ventilator. Rear shell 6 also includes fan cowlings 168, 170 disposed in compartments 158, 160 to specifically form the rear sections of air channels 164, 166. As in the case of the front cowlings, rear cowlings 168, 170 enhance air flow efficiency and improve directionality for the reasons noted in connection with front cowlings 96, 98. And, like cowlings 96, 98, cowlings 168, 170 are formed with cylindrical external contours 171, 173, respectively, and radially asymmetrical internal contours 172, 174, respectively, to orient their effective internal length axes which are an extension of the length axes for cowlings 96, 98; i.e., 97, 99, respectively, at a convergent angle. This orients at length axes of ventilator air channels 164, 166; i.e., 97, 99, respectively, at a convergent angle to encourage co-mingling of air at the rear of housing 2.

In the case of rear shell cowlings 168, 170, the internal radial contours are diminished at the outboard half of the cowling cross-section to complement the inboard diminishment of front cowlings 96, 98, respectively. Additionally, for rear cowlings 168, 170, the radial diminishment decreases from ends 176, 178, respectively, at grille work 140, to ends 180, 182, respectively, proximate frame 8 as best seen in FIG. 3.

As seen in FIG. 1, rear shell 6 also includes a plurality of gusseted mounting posts 184. Posts 184 enable shell 6 to be mounted to frame 8. Particularly, posts 184 are distributed over shell 6; e.g., proximate top and bottom walls 134, 136 at partition 162, and side walls 130, 132, respectively. Posts 184 are each provided with a bore 186 for receiving assembly screw 188. Bores 186 is sized to permit the screw threads, but not the screw heads to pass through. Further, the bores 186 may be provided with a countersink to permit the screw head to be recessed within posts 184.

Posts 184 align with apertures 186 in frame panel 44 and corresponding posts 188 provided at front shell 4 (not shown) which like posts 184 allows shell 4 to be assembled to frame 8. Like rear shell posts 184, front shell posts 188 are provided with bores 190 for receiving screws 188. However, while bores 186 of rear posts 184 are sized to permit the screw threads to pass through, bores 190 of front posts 188 are sized so that the threads can screw into and self-tap at front posts 188. This arrangement enables shells 4 and 6 to be easily and quickly assembled with frame 8 to form ventilator housing 2. As will be appreciated by those skilled in the art, other known closure techniques could readily be substituted.

As noted above, both walls 60 and 136 of the front and rear housing shell, respectively, each include support assemblies 18 to enable housing 2 to freely stand; e.g., when the ventilator is used within a room on a table, floor, etc. Particularly, two support assemblies 18 are evenly located, each one approximately beneath each fan unit on each shell, as shown. Assemblies 18 are alike, and can be understood with reference to the assembly at the right of front shell 4. Particularly, assembly 18 includes a generally rectangular base 192 which depends from shell wall 60. The base may be fastened to the wall in any convenient manner; e.g., by screws, or integrally formed with the shell. The height of the base is selected to approximate the extension of frame lower side 116 below bottom wall 60, with the result that housing 2 may stand upon frame lower side 116 and base 192 as well as the bases of the other support assemblies.

Additionally, support assembly 18 includes a rectangular leg 194 to stabilize the housing against movement; e.g., sliding, tipping, etc. Leg 194 is formed by a rod bent in a rectangular shape. The rectangular leg is discontinuance on one short side 196 to permit the rod ends to be received in a bore 198 provided in base 192, as shown. Within bore 198, leg 194 may be rotated to move the leg between a retracted position where leg 194 is located in a space 200 between base 192 and frame lower side 116, and a deployed position to the front of base 192 as best seen in FIG. 4. Second short side 202 of leg 194 is provided with a foot 204 of, for example, rubber to discourage movement when leg 194 is deployed.

Continuing with reference to FIG. 1, ventilator 1 in accordance with this invention also includes filter assembly 14. Filter assembly 14 is provided to filter air entering or exiting air channels 164, 166, respectively. As seen in FIG. 1, filter assembly 14 includes a frame of the 206 of generally rectangular, flat shape. Frame 106 includes vertical support ribs 108 positioned between frame top and bottom border elements 210, 212, respectively, so as to form a recess 214 for receiving a filter element 216. A rectangular retainer 218 may be fastened to the frame by means of screws 220 to hold filter element 216 in place within recess 214. For convenience and ease of access, assembly 14 is mounted at the rear of ventilator 1 on wall 128. Clips 222 are provided orthogonally on frame side elements 224, 226 which cooperate with slots in the rear wall of shell 6 (not shown) to mount assembly 14 to the back of ventilator 1. As will be appreciated, other suitable mounting arrangements known in the art could be substituted. As will also be appreciated, since the function of assembly 14 is to filter air moving through channels 164 and 166, respectively, assembly could also be mounted on front wall 52 to filter air moving through the channels as it enters grille 64. Likewise filter elements similar in function to assembly could also be placed within channels 164 and 166, to accomplish the same result.

In accordance with the invention, filter element 216 may take a variety of forms. It may be a woven screen as shown in FIG. 1, where only coarse filtration of ventilator air is desired. Or, it may be a fibrous mat 216' of uniform density as shown in FIG. 8A to permit finer filtration than possible with screen 216 of FIG. 1. Where the filter element is of the form shown in FIG. 8A, its density and thickness is selected based on the degree of filtration desired and the flow characteristics of ventilator 1, as is well-known in the art. Additionally, and in accordance with this invention, the filter element is required to be bi-directional; i.e., able to filter air passing into and out of the ventilator rear grille 140. Accordingly, the density and thickness of the filter element in preferred form is selected to avoid build-up of filtered material at the element faces. If filtered material is allowed to accumulate at the faces of the filter element, the accumulated matter may be caused to be blown from the element into the air stream when air flow is reversed as when the ventilator mode of operation is changed. To avoid buildup at the filter element face, filter density is preferably held low so that the material to be filtered penetrates a depth into the element sufficient to discourage accumulation from being blown from the element when air flow is reversed. If a high degree of filtration is sought, the filter element thickness may be increased to achieve the desired result.

Where element thickness becomes objectionable for higher levels of filtration, an element 216'' as shown in FIG. 8B having a composite structure may be used. Particularly, a filter element of higher density 228'' may be sandwiched between two elements 230'', 232'' of lower density. In this arrangement, the material to be filtered may penetrate the low density material 230'' or 232'' a sufficient depth before being trapped to discourage release when air flow is reversed, while desired levels of filtration may be achieved in the central higher density element 228''.

As noted, the ventilator of this invention is able to offer multiple modes of operation. This is made possible by providing ventilator 1 with a controller 16 capable of selectively activating fan units 10 and 12. In accordance with the invention, controller 16 features an assembly of multiple switches and an electrical network for interconnecting the switches, fan motors and a source of electric power. As seen in FIG. 1, controller 16 includes a multi-switch assembly 234 mounted on a housing 236. As shown schmatically in FIG. 5, within housing 236, the switches of assembly 234 are mounted on a printed circuit board 238 upon which an interconnection network 240 is laid out.

Figure 5:
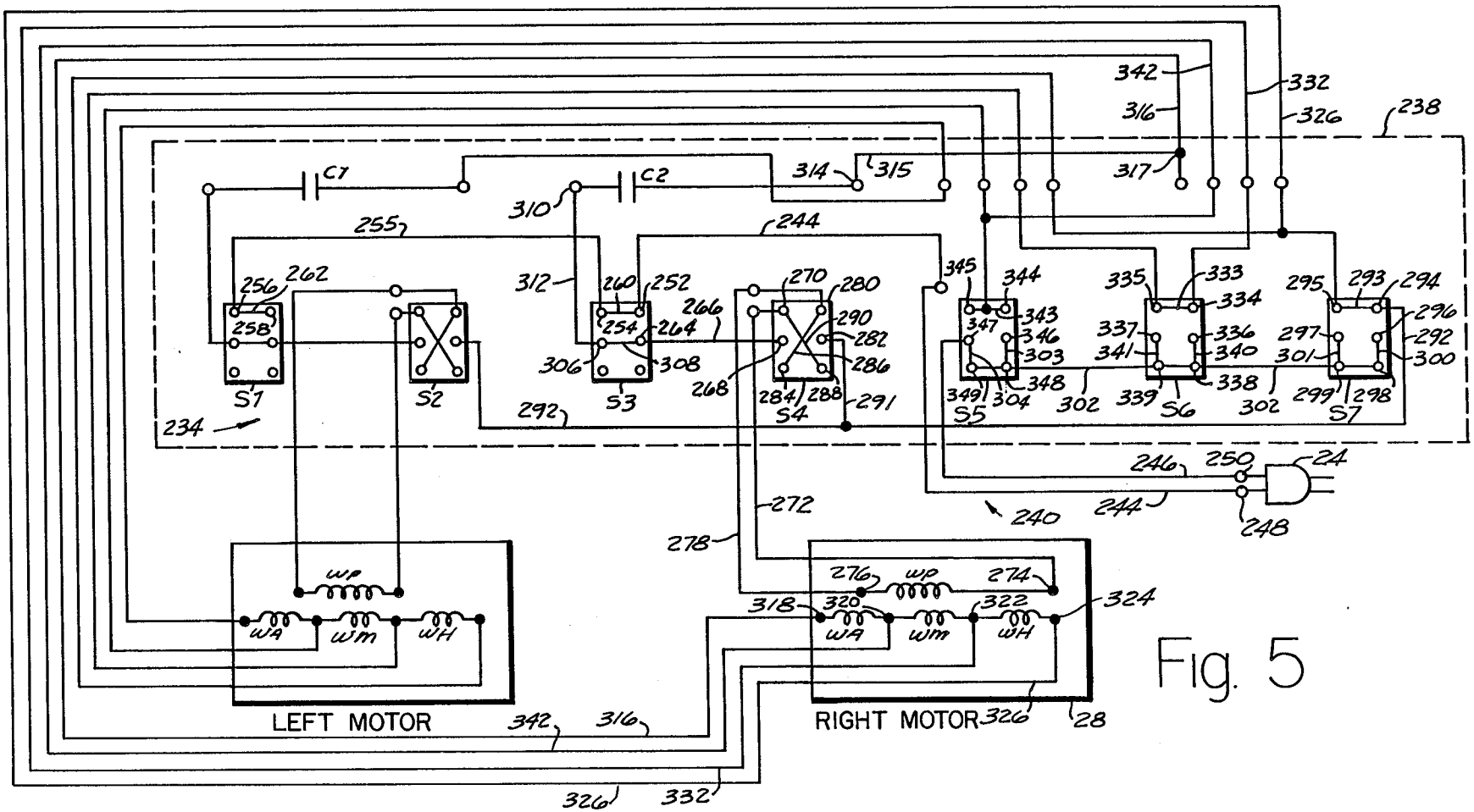
FIG. 5 is a schematic drawing of the control means switches and electrical network in association with the motors of the ventilator in accordance with the invention.

With reference to FIG. 5, switch assembly 234 is seen to include some seven switches, S1–S7. Switch S1 controls the on-off function of the left fan motor. Switch S2 controls the polarity of the left fan motor and, therefore, the direction of rotation of the associated fan blade and direction of air movement in left channel 166. Switch S3 controls the on-off function of right fan motor 28, while Switch S4 controls the polarity of the right fan motor and the direction of blade rotation and air movement in right air channel 164. Switches S5, S6 and S7 cooperate to control the speed of each or both motors. As noted earlier, the fan motors have multiple stator windings and are capable of multiple speeds. Particularly, activation of Switch S5 causes either or both fan motors to run at low speed, which in preferred form is between approximately 1,700 to 2,000 rpm. Activation of Switch S6 causes either or both motors to run at medium speed, between approximately 2,000 to 2,400 rpm in preferred form. And activation of Switch S7 causes either or both motors to run at high speed, in preferred form between approximately 2,300 to 3,000 rpm. In this arrangement, the speed switches are mechanically coupled as is known in the art, so that activation of one deactivates the others, thereby permitting only one switch to be activated at a time.

In the preferred form shown, Switches S1–S7 are of the double pull-double throw type and are manually operated by means of push buttons as seen in FIG. 1. Each switch is provided with six terminals disposed in three rows and two columns as shown schematically in FIG. 5. As is well-known in the art, switches of this type are capable of connecting the middle terminal of each column to either the upper or lower terminal of its respective column by selecting one of two switch positions. Particularly, in preferred form, a first position is defined with the button pushed in, and a second position with it out. Thus by manipulating the switch, circuits connected to the two sets of terminals (one set per column) can each be switched between a first condition and a second condition.

With reference to FIG. 5, the various terminals of Switches S1–S7 are connected to the windings of the right and left fan motors and a source of electrical power by means of network 240, network 240 being embodied on printed circuit board 238 in a manner well known in the printed circuit board art.

Continuing with reference to FIG. 5, network 240 includes power input lines 244 and 246 which are connected at points 248, 250, respectively, to a conventional power cord 24. Power cord 24 in turn may be readily plugged into a 120 volt, 60 Hertz electrical power outlet; e.g., a wall socket, to supply power to the network. Power line 244 is also connected to a parallel combination of motor on-off switches S1, S3. As shown, line 244 is connected to upper terminals 252, 254 of Switch S3 and upper terminals 256, 258 of Switch S1. Specifically, line 244 is connected to terminal 252 of Switch S3, and terminal 252 is electrically tied to terminal 254 by a strap 260. Continuing, Switch S3 terminal 254 is connected by a line 255 to terminal 256 of Switch S3 and terminal 256 tied to terminal 258 by a strap 262.

Since the circuit connections and components for the right and left fan motors are alike, for simplicity, reference will be made to the right motor only. Where discussion of both motors is required for an understanding of network 240, it will be provided.

With reference to the right fan motor and considering the primary winding circuit of the motor, middle terminal 264 of Switch S3 is connected by a strap 266 to middle terminal 268 of Switch S4, Switch S4 being arranged to permit reversal of the polarity of the motor and, thereby, reversal of the direction of rotation of the associated fan blade. Particularly, upper terminal 270 associated with middle terminal 268 is connected by line 272 to one side of the motor primary stator winding $W_p$ at 274. The other side of winding $W_p$ is connected at 276 by line 278 to upper terminal 280 associated with middle terminal 282 of Switch S4. Further, upper terminal 280 is cross tied to lower terminal 284 by strap 286, and upper terminal 270 cross tied to lower terminal 280 by strap 290. While straps 286, 290 cross, they are electrically isolated. As will be appreciated, and with the usual schematic convention, crossing lines in FIG. 5 are electrically isolated unless shown joined by a junction point. As also shown in FIG. 5, middle terminal 282 of Switch S4 is connected by lines 291, 292 to upper terminal 294 of Switch S7, the high-speed selection switch. Middle terminal 296 of Switch S7 is, in turn, tied to lower terminal 198 by strap 300. Continuing, terminal 298 is electrically tied by line 302 and a strap 304 to power line 246, which, as noted, is connected to power cord 24 at 250.

With this arrangement, the polarity of motor 28; i.e., the direction of current flow in right motor winding $W_p$ at the beginning of a cycle, and the associated direction of air flow in ventilator right channel can be readily reversed by simply manipulating Switch S4. For example, assuming power on-off Switch S3 is closed; i.e., pushed in so that upper terminal 252 is connected to middle terminal 264, current from line 244 will flow to central terminal 268 of Switch S4 over strap 266. If Switch S4 is pushed in; i.e., disposed with central terminal 268 connected to upper terminal 270, current at the beginning of a cycle will, thereafter, flow through winding $W_p$ from point 274 to point 276. Subsequently, current will return to line 244 by upper terminal 280 of Switch S4 and central terminal 262. While, based on the description given it would appear necessary for Switch S7 to be closed; i.e., pushed in so that upper terminal 294 is connected to middle terminal 246,in order to couple to power line 246, as will be more fully explained, each of Switches S7, S6 and S5 are arranged to potentially complete the path from winding $W_p$ to line 246. Therefore, it is sufficient if anyone of the speed switches, S5–S7, is closed. However, if none of Switches S5–S7 are closed; i.e., pushed in, the motor circuit can not be completed, and the motor will not be energized.

To reverse current flow in winding $W_p$ all that is required is for Switch S4 to be altered; i.e., switched from its first position to its second position. Particularly, if Switch S4 were reconfigured so that middle terminal 268 was connected to lower terminal 284 instead of upper terminal 270, current at the beginning of a cycle from Switch S1 would pass from terminal 284 to upper terminal 280 over strap 286, and thereafter, pass through winding $W_p$ from 276 to 274, the reverse of the previous configuration. Subsequently, current would be returned to line 246 over upper terminal 270, strap 290, lower terminal 288 and middle terminal 282. Again, the final connection with line 246 would be made through either Switch S7, S6 or S5.

As it will be appreciated by those skilled in the art, because Switches S1 and S2 are arranged like Switches S3 and S4, the polarity of the left fan motor and the associated direction of air flow in left air channel 166 may be reversed in the same manner as described for the right fan motor.

In order to maintain ventilator cost low, variable speed motors 28 are common, single-phase, permanent-split, A.C. types having multiple speed windings. Accordingly, and as will be appreciated, each motor requires an auxiliary circuit containing a running capacitor and auxiliary motor windings to achieve desired operation. In accordance with this invention, network 240 enables efficient connection of the auxiliary circuit to the motor primary circuit. Again, because the right and left motor circuits are alike and arranged in parallel, an understanding of both can be obtained by referring to the right motor alone.

As noted, electrical power is supplied to right motor 28 through Switch S3. In addition to supplying power to the motor primary winding $W_p$ and polarity reversing switch S4 as described, Switch S3 also supplies power to the motor auxiliary circuit which contains the compensating capacity, auxiliary winding for motor operation and the motor multiple speed windings. Particularly, Switch S3 middle terminal 306 is connected to one side of capacitor C2 at 310 by line 312. As is well-known in the art, the value of capacitor C2 is selected to permit motor 28 to operate in the permanent-split mode. Continuing with reference to FIG. 5, the other side of capacitor C2 is connected at 314 to line 315, and by line 315 to line 316 at 317, and by line 316 to one side of the motor auxiliary winding $W_a$ at 318. Additionally, the other side of auxiliary winding $W_a$ is connected at 320 to one side of motor medium speed winding $W_m$. Still further, the other side of medium speed winding $W_m$ is connected to one side of motor high-speed winding $W_h$ at 322, and the other side of high-speed winding $W_h$ is connected at 324 to line 326. Line 326, in turn, is electrically connected to upper terminal 295 of high-speed Switch S7, which is tied to terminal 294 is switchable to middle terminal 297 of Switch S7, terminal 297 being tied to electrical power line 246 by straps 300, 304 and line 302.

With this connection, the series combination of capacitor C2 and motor windings $W_a$, $W_m$ and $W_h$ are connected in parallel with the motor primary circuit which includes Switch S4 and primary winding $W_p$. However, the interconnection of the motor primary and auxiliary circuits does not stop here. Network 240 also connects low and medium speed Switches S5 and S6, respectively, in combination with high-speed Switch S7 so that medium speed winding $W_m$ and high-speed winding $W_h$ can, in effect, be withdrawn from the motor auxiliary circuit and placed in the motor primary circuit. Specifically, and as seen in FIG. 5, point 322 between winding $W_m$ and $W_h$ is connected by line 332 to upper terminals 334, 335 of Switch S6. As in the case of Switch S7, middle terminals 336, 337 of Switch S6 are tied to lower terminals 338, 339 by straps 340, 341, respectively, and, thereafter, connected with line 246 by line 302 and strap 304. Additionally, point 320 between motor auxiliary winding $W_a$ and medium speed winding $W_m$ is connected by line 342 to upper terminals 344, 345 of low-speed Switch S5. Similar to Switches S6, S7, the middle terminals of Switch S5, respectively, 346, 347 are connected to lower terminals 348, 349 by straps 303, 304, respectively.

The consequence of this arrangement is that the electrical power line 246 can be selectively connected at either point 320, 322, or 324 by switching respectively either Switch S5, S6 or S7; i.e., manipulating the switch such that the middle terminals are connected to the upper terminals. Where Switch S5 is activated; i.e., pushed in so that middle terminals 346, 347 are connected to upper terminals 344, 345, respectively, the motor auxiliary circuit includes the series combination of capacitor C2 and auxiliary winding $W_a$; windings $W_m$, $W_h$, being arranged in series with motor primary winding $W_p$. This produces low speed operation of motor 28. Where Switch S6 is activated; i.e., pushed in so that middle terminals 336, 337 are connected to terminals to upper terminals 334, 335, respectively, the auxiliary circuit includes the series combination of capacitor C2, auxiliary winding $W_a$ and medium-speed winding $W_m$; high-speed winding $W_h$ being arranged in series with primary winding $W_p$. This produces medium speed operation of motor 28. Finally, where Switch S7 is activated; i.e., pushed in so that middle terminals 296, 297 and connected to upper terminals 294, 295, respectively, the auxiliary circuit includes capacitor C2 and windings $W_a$, $W_m$ and $W_h$, leaving the mode of primary circuit with only winding $W_p$. This produces high speed operation of motor 28.

With this arrangement the medium and high speed windings can be selectively patched into the motor auxiliary circuit to vary motor speed without need for separate wiring and switches. Thus, the arrangement reduces the expense of providing multi-speed operation as well as other advantages that will be apparent to those skilled in the art.

As seen in FIG. 5, and as will be clear to those skilled in the art, the circuits of the left motor are integrated with those of the right motor by connecting the speed switches in parallel in both, as shown. Accordingly, ventilator cost and complexity is further reduced by utilizing a single set of speed switches for both motor arrangements.

With regard to ventilator operation, as pointed out at the outset, the ventilator of this invention is capable of operating in a number of different modes. These modes span a range of operation previously unavailable in a single ventilator. The modes include not only the ability to move air, but also the ability to either emphasize conservation of ambient air temperature by circulating filtered room air, or to emphasize air quality by exhausting stale room air and taking in filtered, fresh, external air.

Particularly, and with reference to the figures, ventilator 1 has three basic modes of operation. It can filter and move air in a first direction; it can filter and move air in a second direction; or it can filter and move air in a first and a second direction and, at least partially circulate double filtered air. However, because the ventilator is portable, these three modes of operation can be increased to six by either locating the ventilator in a space, such as a room, where it can process room ambient air, or in a window or wall port where it can process both ambient room air and air external to the room.

Where the user wishes to emphasize air temperature conservation, while contributing to air quality, the ventilator would be located within the room mounted; for example, on a table or the floor by deploying supports 18. Where the flow of only one fan is desired, the user can elect to move air in a first general direction; i.e., operate in the first mode, by activating only right fan unit 10.

By setting Switch S3 to the on position, power is supplied from a source, such as a wall socket, over line cord 24 to activate right side fan motor 28. Next, the user can elect; for example, to move air from the rear of the ventilator toward the front by setting Switch S4 so that the polarity of motor 28 causes power to flow in the motor primary winding $W_p$ such that fan blade 26 is rotated in a direction that draws room air into channel 164 at the rear of housing 2 through filter element 216 and rear grille 140, and, thereafter, through channel 164 as directed by rear cowling 168 and front cowling 96 to exit the ventilator housing to the room at front grille 64.

Alternatively, if the user wishes to move room air in a second direction; e.g., from the front of the ventilator toward the rear; i.e. operate in a second mode, and, again, assuming the flow of one fan is adequate, the user simply maintains right fan power Switch S3 on, and resets companion Switch S4 such that the polarity of motor 28 is reversed to cause fan blade 26 to rotate in the opposite direction. Rotating fan blade 26 in the opposite direction will draw room air into channel 164 at the front of the ventilator, through front grille 64 and, thereafter, through channel 164 as directed by front cowling 96 and rear cowling 168 to exit the ventilator to the room through rear grille 140 and filter element 216.

If the user desires a greater air flow in the first mode than available from fan 10 alone, left fan 12 can also be activated in the same sense as right fan 10; i.e., Switches S2, S4 set for the air direction of the first mode. In this case, air will be taken in at the rear of the ventilator at grille 140 and filter element 216 to both channels 164 and 166, and expelled from both air channels 164 and 166 at the ventilator front, through grille 64. Likewise, where the user desires to have both fan unit 10 and 12 move air in second direction; i.e., second mode of operation, Switch S2 and S4 are reset to the same sense so that air is taken in at the front of the ventilator through grille 64 and channels 164 and 166, and expelled to the room from channels 164 and 166 through grille 140 and filter element 216.

As will be appreciated, since channels 164, 166 have length axes which are arranged to converge at the rear of the ventilator in the embodiments shown in FIGS. 2 and 6, the direction of air within the channels will be slightly different for those embodiments in the first and second modes. However, the effective general direction of air for the channels will be the same, either from the rear to the front or from the front to the rear of the ventilator.

Where the user wishes to emphasize air temperature conservation and maximize the contribution to air quality, the ventilator can be operated within the room in the third mode. In the third mode, both right fan 10 and left fan 12 are activated, however, the polarity of the fan units are set opposite to one another so that air is expelled; for example, from right channel 164 through filter 216 at the ventilator rear grille 140, and drawn in at left channel 166 at the ventilator rear through filter element 216 and grille 140. As a result, expelled filtered air from right channel 164 can co-mingled with the air to be taken in at left channel 166 through filter element 216 to at least partially double filter and circulate room air. Thus by selecting the third mode of operation, the user can elect to conserve air temperature by circulating room, while, at the same time, improving air quality by double filtering the circulated air. Further, and as will be appreciated, due to the proximity of channels 164 and 166 at front grille 64, air exiting channel 166 will partially co-mingle with air being taken in at channel 166 to permit further filtering at filter element 216 as the air is circulated.

More particularly, in the third mode of operation, power Switch S3 of right fan unit 10 will be on and companion polarity Switch S4 set; for example, so that power flow in motor primary $W_p$ causes air to move through channel 164 from front grille 64 as directed by front cowling 96 and rear cowling 168 to exit the ventilator through rear grille 140 and filter element 216. Further, power Switch S1 of left fan unit 12 is set on and companion polarity Switch S2 set so power would flow in the motor primary winding to cause air to move through channel 166 from filter element 216 and real grille 140 as directed by front cowling 170 and front cowling 98, and exit the ventilator at front grille 64.

With this operation, air exiting channel 164 and filter element 216 will at least partially co-mingle with air entering channel 166 at filter element 216 and grille 140, thus, enabling the dobule filtering and circulation of room air. As noted, setting th elength axes of channels 164 and 166 at a convergent angle aids the co-mingling process.

Continuing with reference to the figures, additional modes of ventilator operation can also be selected. Where the user wishes to emphasize air quality; i.e., freshness, the user can locate the ventilator in a window or wall port of an enclosure that at least partially surrounds the space; e.g., a room, to be ventilated.

For example, where the frame partitions 20, 22 are depolyed to fit the ventilator at a room window, at least three additional modes of operation can be selected. Specifically, the user can elect, as a fourth mode, to exclusively draw in fresh, external air to the room; or as a fifth mode of operation, to exclusively exhaust stale room air; or, as a sixth mode of operation, to both draw in fresh air and exhaust stale air and to additionally at least partially circulate double filtered room air. As will be appreciated, for the fourth to the sixth modes of operation, the ventilator would be oriented with front housing shell in communication with the space to be ventilated, and rear housing shell 6 in communication with the environment external to the room. Additionally, frame 8 would be arranged at the window as a bulkhead, separating the room from the external environment.

Where the user wishes to emphasize air quality with out regard to air temperature conservation, the user can operate the ventilator to either drawn in fresh air or exhaust stale air.

Particularly, in the fourth mode, the user can move fresh air from the external environment at the rear of the ventilator to the room at the front of the ventilator. With the ventilator mounted at a window, the user can select the fourth mode by setting the controller switches as in the first mode of operation described above. Reference to the description of the first mode will provide an to understanding of how switches S1–S4 may be arranged.

Continuing, in the fifth mode, the user can move stale room air at the front of the ventilator to the external environment a the rear of the ventilator. In the fifth mode of operation the controller switches could be set as described in connection with the second mode of operation. Again, reference may be made to the second mode of operation to understand how Switches S1–S4 can be arranged to effect operation in the fifth mode.

Finally, where the user wishes to emphasize air quality, but also wishes to contribute to air temperature conservation, the sixth mode of operation can be selected. In the sixth mode of operation, the user can move fresh air from the external environment into the room through one channel; e.g., 166, and exhaust stale air to the external environment through the other channel, e.g., 164, and double filter at least a portion of the room air exhausted at channel 164 and circulate it to the room through channel 166. Again, reference can be made to the parellel ventilator operation within the room, particularly mode three, for an illustration of how the controller switches might be configured in the sixth mode.

As noted, due to the proximity of channels 164 and 166, at front grille 64, some added circulation and repeated filtering of air is likely and will enhance air quality without loss of room temperature.

As noted in connection with the description of the ventilator controller, in accordance with the invention, ventilator fan motors 28 are capable of multiple speeds. Accordly, the user can further vary the modes of operation described by varying motor speed. Particularly, regardless of the configuration of controller Switches S1–S4, the user can further select one of three speeds for the fans that are activated by appropriate selection of Switches S5–S7. Accordingly, air flow in any of the ventilator modes of operation can be varied by simply changing the speed selected.

As also noted, air circulation serves to diminish the negative effects of emphasising either air temperature conservation or air quality improvement. In accordance with the invention, circulation is encouraged by co-mingling the air moved through the ventilator channels. In the embodiment shown in FIGS. 1 to 5, co-mingling is promoted by orienting channel axes 97, 99 at a convergent angle through the use of asymmetrical radial contours for the cowling, as described. Other means could also be used to orient the channel length axes at a convergent angle. Further, means other than orienting the channel axes at a convergent angle could be used to encourage co-mingling of air.

For example, FIG. 6 shows a further form of ventilator 1 in which similar ventilator elements are designated with similar numbers which have been double primed for clarity. The ventilator of FIG. 6 shows an alternate approach for setting the length axis of the air channels at a convergent angle to encourage air co-mingling at the ventilator rear. Particularly, and as seen in FIG. 6, cowlings 96'', 98'' and 168'', 170'' are cylindrical and oriented with respect to front wall 52'' of housing shell 4'' and rear wall 128'' of housing shell 6'' to establish the convergent angle for air channels 164: and 166'', respectively, in order to encourage co-mingling at the ventilator rear in the third and sixth operating mode.

In the ventilator shown in FIG. 7, like ventilator elements are designated with like numbers that have been primed. In FIG. 6, an alternative to orienting the channel axes at a convergent angle to promote air co-mingling, is show. Particularly, in the ventilator of FIG. 7, the air channels 164' and 166' have been oriented orthogonally to the ventilator walls 52' and 128', and placed in close proximity to promote co-mingling. As shown, the channels 164' and 166' are proximate not only at rear wall 128' but also front wall 52'. Accordingly, co-mingling will occur at both sides of the ventilator. While this approach has the advantage of providing additional circulation, as would be obvious, the proximity and coupling between channels should not be so great as to cause air to be continuously circulated within the ventilator.

Finally, as a yet further approach to promoting co-mingling at the ventilator rear, deflector means; e.g., baffles, not shown, may be provided at the rear or the ventilator; e.g., mounted to the filter assembly frame, to deflect air exiting the channels so as to encourage co-mingling. As will also be appreciated similar elements could also be used at the front of the ventilator, to promote co-mingling and circulation. However, as noted above, co-mingling at the ventilator front should not be so great as to cause excessive circulation between the air channels.

As will also be appreciated the materials selected for the ventilator can be of any convenient type. In preferred form, housing shells 4, 6 may be made of plastic suitable to permit molding of the elements. Further, frame 8 may be made of metal or other material of sufficient strength to provide adequate support for the ventilator elements which are fixed to it.

While this invention has been described in its preferred forms, it will be appreciated that changes may be made in form, construction and arrangement of the elements without departing from its spirit or scope.

What I claim is:

1. A ventilator having multiple modes of operation for selectively, moving air associated with a space in a plurality of direction, the ventilator comprising:

structural means for forming a ventilator housing assembly;

conduit means located internally of the housing for forming a plurality of separate air channels, the channels having like ends disposed in association with one another;

a plurality of electric fan means each of which is disposed in an air channel for selectively moving air therethrough;

filter means for filtering air which moves through the channels;

control means for electrically controlling the plurality of fan means such that in a first selectable mode of operation air is moved in a first direction through at least some channels and the filter means, and in a second mode of operation air is moved in a second direction through at least some channels and the filter means, and in a third mode of operation air is moved in the first direction through at least some channels and the filter means, and in the second direction through the filter means and at least some channels other than those through which air is moving in the first direction, and thereafter at least a portion of the air moving in the first direction is drawn back through the filter means and the channels in which air is moving in the second direction to at least partially circulate and filter air in the space.

2. The ventilator of claim 1 wherein the control means includes electrical circuit elements for selectively supplying electrical power to the fan means so that air may be selectively moved through the channels, and wherein the control means also includes electrical circuit elements for selectively varying the polarity of the fan means so as to selectively reverse the direction of air movement in the respective channels.

3. The ventilator of claim 2 wherein at least some of the fan means each have variable speeds, and wherein the control means also includes electrical circuit elements, for varying the speed of the fan means, at least some of the speed varying elements being commonly connected to at least some of the variable speed fan means to commonly control the speed of the fan means to which they are connected and to thereby commonly vary the flow of air in the associated channels.

4. The ventilator of claim 3 wherein the circuit elements of the control means includes a plurality of switches and an electrical network for selectively reversing the polarity of the fan means, for selectively supplying power to the fan means and for varying the speed of the fan means, the control means including a first switch for each fan means to control the supply of power to the respective fan means, a second switch for each fan means to control the polarity of power supplied to the respective fan means and multiple additional switches, each of which control selection of a different speed which is common to all powered fan means.

5. The ventilator of claim 2 wherein the length axis of the respective channels are disposed at convergent angles with each other in the direction of the housing where the filter means is located so that air which moves through the channels may at least partially co-mingle at the ends of the respective channels at which the filter means is located.

6. The ventilator of claim 2 further including air deflector means disposed at like ends of at least some channels at which the filter means is located to cause air which moves in the channels to at least partially co-mingle at the like channel end and filter means at which the deflector means is disposed.

7. The ventilator of claim 2 where in the channels are disposed in proximity to one another so that air which moves through the respective channels may at least partially co-mingle at like channel ends.

8. The ventilator of claim 5 wherein the plurality of air channels and fan means consist of two air channels within each of which a reversible, electric fan is mounted for moving air through the respective channel, and wherein the control means includes a plurality of switches and an electrical network for controlling operation of the fans, and, further, wherein the filter means includes a filter element mounted in association with each channel for filtering air which moves in any direction through the respective channels.

9. The ventilatior of claim 8 wherein the conduit means includes a front and rear cowling surrounding each of the fans so as to form the respective air channels, the cowlings being radially asymmetrical along their length so that the length axis of the respective channels are disposed at a convergent angle.

10. The ventilator of claim 9 wherein the cowlings are part of a housing, the housing including a front shell and a rear shell, the front cowling forming part of the front housing shell and the rear cowling forming part of the rear housing shell and wherein the housing front and rear shells enclose the fans, the fans being mounted on a frame member at least partially disposed within the housing shells, and further, wherein the control means switches protrude through the housing and are accessible for manual manipulation.

11. The ventilator of claim 7 wherein the plurality of air channels and fan means consist of two air channels within each of which a reversible, electric fan is mounted for moving air through the respective channel, and wherein the control means includes a plurality of switches and an electrical network for controlling operation of the fans, and, further, wherein the filter means includes a filter element mounted in association with each channel for filtering air which moves in any direction through the respective channels.

12. The ventilatior of claim 11 wherein the conduit means includes the front and rear cowling surrounding each of the fans so as to form the respective air channels, the cowlings being radially asymmetrical along their length so that the length axis of the respective channels are disposed at a convergent angle.

13. The ventilator of claim 12 wherein the cowlings are part of the housing, the housing including a front shell and a rear shell, the front cowling forming part of the front housing shell and the rear cowling forming part of the rear housing shell and wherein the housing front and rear shells enclose the fans, the fans being mounted on a frame member at least partially disposed within the housing shells, and further, wherein the control means switch protrude through the housing and are accessible for manual manipulation.

14. A dual fan ventilator having multiple modes of operation for selectively moving air associated with a space in a plurality of directions, the ventilator comprising:

a housing assembly;

two electrically reversible fans for moving air through the ventilator housing;

cowlings located internally of the housing surrounding each fan so as to form a first and a second separate air channel for directing air through the ventilator;

filter means mounted on the housing assembly disposed in associated with each channel for filtering air which moves through the respective channels;

control means including a plurality of switches and a network electrically connected to the fans for selectively controlling the polarity of the fan means such that in a first mode of operation, air is moved only in a first direction through at least one channel and the filter means and in a second mode of operation air is moved only in a second direction through at least one channel and the filter means and in a third mode of operation, air is moved in the first direction through the first channel and the filter means and in the second direction through the filter means and the second channel and following exit from the first channel, at least a portion of the air moving in the first direction is drawn back in the second direction into the filter means and the second channel to at least partially circulate air in the room.

15. The ventilator of claim 14 wherein the length axis of the first and second channel are disposed at a convergent angle so that air which moves in the channels may at least partially co-mingle at the ends of the first and second channel at which the filter means is located.

16. The ventilator of claim 15 wherein the cowlings associated with the respective fans are cylinderical.

17. The ventilator of claim 15 wherein the cowlings associated with the respective fans are radially asymmetrical along their length so that the effective length axis of the first and second channel are disposed at a convergent angle to cause air moving in the channels to at least partially co-mingle at the ends of the first and second channel at which the filter means is located.

18. The ventilator of claim 17 wherein the cowlings are part of the housing, the housing including a front shell and a rear shell and wherein the housing front and rear shell enclose the fans, the fans being mounted on a frame member at least partially disposed within the housing shells, and, further, wherein the control means switches are mouned within the housing so that the switches protrude through the housing and are accessible for manual manipulation.

19. The ventilator of claim 18 wherein each of the fans have variable speeds, and wherein the control means switches and network are arranged to selectively supplying power to the fans, selectively reverse the polarity of the fans, and vary the speed of the fans.

20. The ventilator of claim 19 wherein the control means switches for varying the speed of the fan means are commonly connected to the fans to commonly control the speed of the fans, and, thereby, commonly vary the flow of air in the channels.

* * * * *